US005462349A

United States Patent [19]

Grabher

[11] Patent Number: 5,462,349

[45] Date of Patent: Oct. 31, 1995

[54] DRAWER WITH DRAWER SIDE SLIDE AND DRAWER BOTTOM

[75] Inventor: Günther Grabher, Fussach, Austria

[73] Assignee: Grass AG, Hoechst/Vlbg., Austria

[21] Appl. No.: 213,940

[22] Filed: Mar. 16, 1994

[30] Foreign Application Priority Data

Mar. 17, 1993 [DE] Germany ..... 9303903 U

[51] Int. Cl.[6] ..... A47B 88/04

[52] U.S. Cl. ..... 312/348.1; 312/330.1; 312/348.2; 403/283

[58] Field of Search ..... 1/9; 312/330.1, 312/348.1, 348.2, 348.4; 403/279, 282, 283

[56] References Cited

U.S. PATENT DOCUMENTS

| | | | |
|---|---|---|---|
| 594,555 | 11/1897 | Preston | 403/283 |
| 1,844,087 | 2/1932 | Boden | 403/283 |
| 2,099,950 | 11/1937 | Whitehead et al. | 403/283 |
| 4,653,821 | 3/1987 | Faust | 312/330.1 X |
| 4,842,351 | 6/1989 | Röck et al. | 312/330.1 X |
| 4,875,747 | 10/1989 | Hollenstein | 312/330.1 |
| 5,090,786 | 2/1992 | Albiez et al. | 312/330.1 |
| 5,172,971 | 12/1992 | Albiez | 312/330.1 X |

*Primary Examiner*—Kenneth J. Dorner
*Assistant Examiner*—Rodney B. White

[57] ABSTRACT

A drawer with drawer side slide and drawer bottom inserts a drawer side slide with a lower horizontal drawer side slide bottom, which supports the drawer bottom in the form of inwardly directed support shanks. The tabs formed from the material of the support shanks are divided from one another by slots, and have grips on their free ends, which dig in a barbed manner with their points into the material of the drawer bottom.

9 Claims, 2 Drawing Sheets

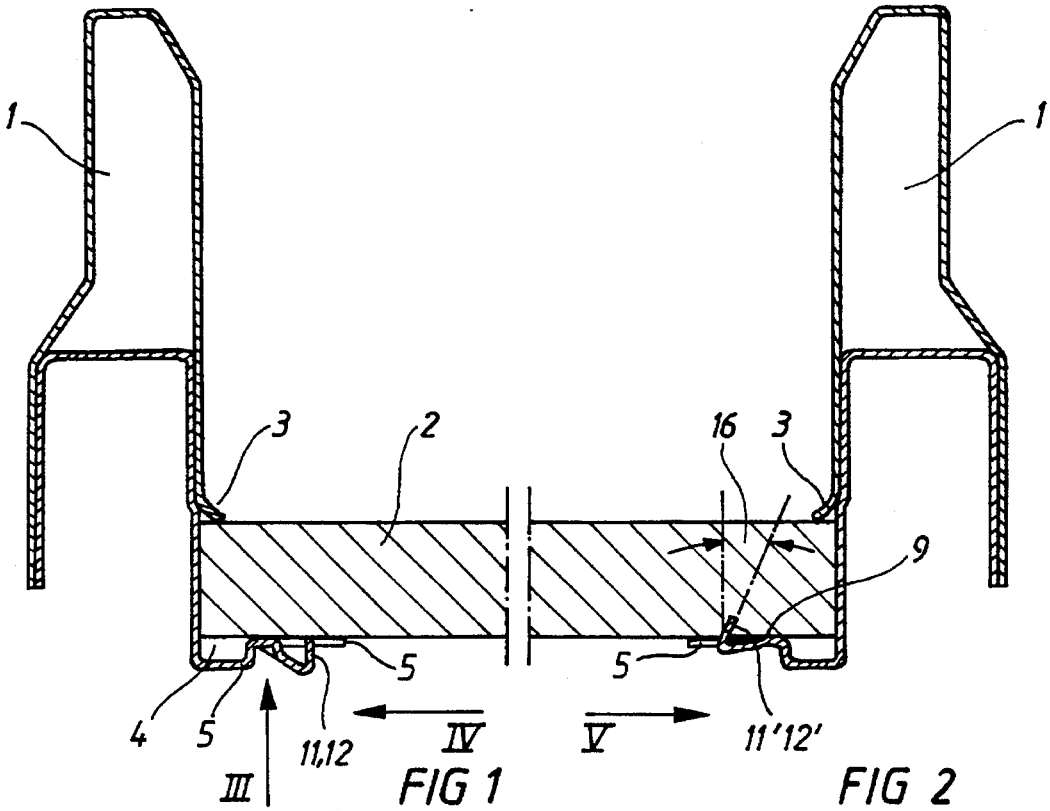
FIG 1
FIG 2
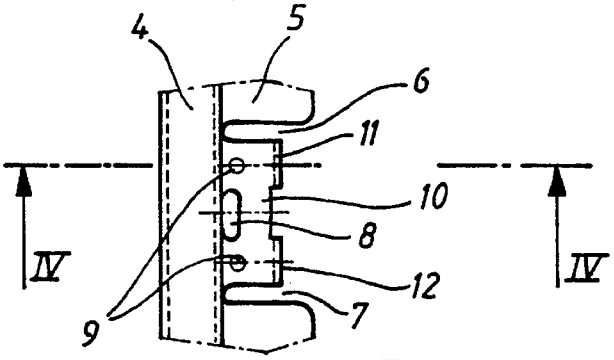
FIG 3
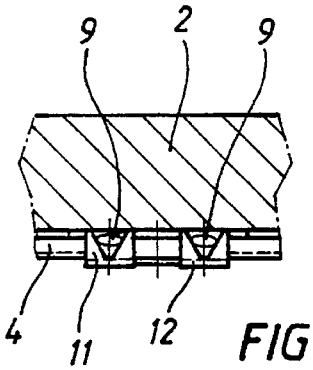
FIG 4
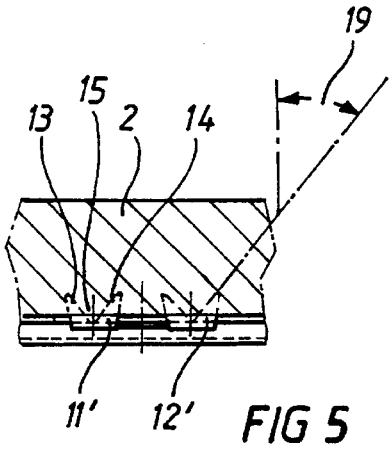
FIG 5

DRAWER WITH DRAWER SIDE SLIDE AND DRAWER BOTTOM

FIELD AND BACKGROUND OF THE INVENTION

The invention concerns a drawer with drawer side slide and drawer bottom, and particularly a drawer side slide with a fastening device for mounting a drawer bottom.

A drawer of the indicated type is made known by the same applicant with the previous patent document DE 91 13 006 U1. By this known directive, upwardly directed tabs are pressed out from the material of the horizontal support shanks of the drawer side slides and are engaged in a corresponding groove on the underside of the drawer bottom. Thereby, the drawer bottom mounts firmly and securely on the support shanks.

The usage of these tabs, however, indicates that the fit in the drawer bottom is capable of being improved because these tabs are formed without grips and a barbed type anchor in the drawer bottom is therefore not guaranteed. Moreover, the drawer bottom must be provided with the aforementioned groove which supposes increased production expenditures.

SUMMARY OF THE INVENTION

The purpose of the invention is to further develop the type of drawer mentioned before so that an operationally reliable and simpler mounting of the drawer bottom to the drawer side slide is guaranteed.

A fundamental feature of the invention is that on free tabs, which are made from the matedal of the support shank, gaps are placed between the slots which partly define the tabs. The grips dig in barbed-like from the underside of the drawer bottom into the drawer bottom without requiring a special shaping of the drawer bottom. Consequently, the groove according to the previous patent, can be dropped.

According to a preferred embodiment of the invention, each grip inserts at least two points, which are directed slanted upwardly in an angle so that the grips spread out slanted when pressed in the drawer bottom and anchor themselves in a barbed manner in the material of the drawer bottom. It is significant that this "spreading out" of the points of the grips follow the "digging in" of the grips in the material of the drawer bottom, so that the points easily bend and secure the grips from being pulled out of the material of the drawer.

In an additional preferred embodiment of the invention, the grips also additionally penetrate slanted in an angle to the vertical in the drawer bottom so that the direction of penetration of the grips is not exactly vertical, but instead, is sloped slanted in the direction of the drawer side. Also by these means the grips are secured against renewed loosening of the drawer bottom.

The grips can be positioned lying behind one another in the pull-out direction of the drawer or parllel to the pull-out direction of the drawer. In another embodiment, the grips can be placed lying behind one another perpendicular to the pull-out direction of the drawer.

An additional feature of the invention is that in the area of the grips, knobs are formed on the tabs which are directed upwardly towards the drawer bottom and which fit against the drawer bottom. In this way the weight transference of the drawer side slide on the horizontal support shanks of the drawer side slide is not on the grips, but instead, is on weight transferring knobs, which are located close to the support shank and therefore—transfer the weight to the support shank of the drawer side slide without danger of bending the tabs.

The inventive basis of the submitted innovation results from not only the matter of the individual protection claims, but also the various combinations of the individual protection claims.

All records, documents and evidence, inclusive of the summary, open and disclosed statements, declarations, indications and features, especially those represented embodiments in the drawings, will be claimed as fundamental and significant to the invention, as far as the claims, individually or in combinations, are relative to the position that the technology is new.

The innovation at hand will be explained more precisely in the following additional embodiment modes by represented drawings. Hereby, additional significant and fundamental features and advantages of the innovation follow from the drawings and their descriptions.

BRIEF DESCRIPTION OF THE DRAWINGS

FIG. 1: Section through the left side of the drawer with grips in an unassembled state;

FIG. 2: Section through the right side of the drawer with grips in an assembled state;

FIG. 3: The view in the arrow direction III in FIG. 1;

FIG. 4: The view in the arrow direction IV in FIG. 1;

FIG. 5: The view in arrow direction V, according to FIG. 2;

DESCRIPTION OF THE PREFERRED EMBODIMENTS

Figure 6:
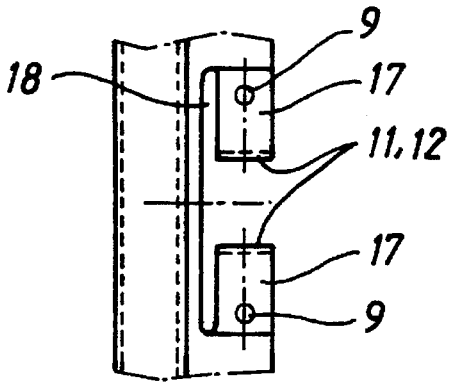
FIG. 6: An opposite embodiment compared to FIG. 3.

According to FIG. 1 and 2, the drawer consists of corresponding drawer side slides (1), each of which has on its underside a horizontal support shank (5), so that the drawer bottom (2) is fastened on the support shanks (5) of the drawer side slides (1) which lie opposite each other.

According to FIGS. 3 through 5, from the material of the support shank (5), a tab (10) is partitioned, which is defined by horizontal slots (6, 7), which are open on one end and terminate near the vertical step of the support shank (5). An elongated hole (8) is placed in the middle area of the tab (10), and the elongated hole serves as a bending facilitator for the grips (11,12) placed on both sides of the elongated hole (8).

In an unassembled state (FIG. 1, FIG. 4), the grips (11,12) insert somewhat perpendicular, upwardly towards the drawer bottom and then are pressed with a tool (not closely represented) so that they engage in an embodied assembled state in FIG. 2, FIG. 5, respectively.

The grips (11,12) are caused to swivel around a pivot point, which lies close to the vertical step of the supporting shank (5), so that they penetrate in an angle (16) directed toward the drawer side in the material of the drawer bottom (2).

When the grips are inserted in drawer bottom drawer bottom (2), lies on the supporting shank (5); and, a groove (4) is defined in the supporting shank (5) adjacent the bottom edge of drawer side (1).

When the grips (11,12) penetrate drawer bottom (2) in positions (11', 12'), the points (13,14) of the grips spread simultaneously outward.

The points (13,14) are defined by a somewhat wedge shaped notch (15) and the angle (19) enlarges itself so that the grips (11,12) with their points (13,14) press themselves in the drawer bottom (2).

This results in a barbed type fixture of the grips (11,12) in the material of the drawer bottom (2).

Near the vertical step of the support shank (5), a knob (9) is pressed out from the material of the shank (10). According to FIG. 4 and FIG. 5, each knob fits, transferring the weight, with the grips (11,12) pressing in the drawer bottom (2) to the underside of the drawer bottom and thereby, functions transferring the drawer weight on the horizontal support shanks (5). The tabs (10) with the grips (11,12) are thereby protected from bending by the affected drawer weight.

Figure 7:
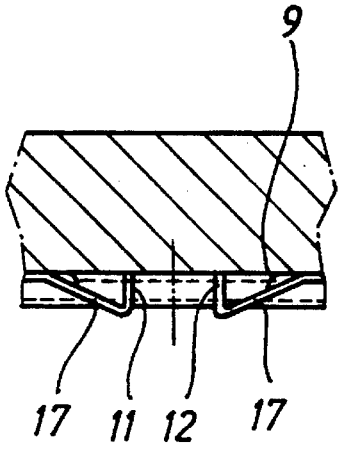
FIG. 7: The embodiment, according to FIG. 6, in an unassembled state.
Figure 8:
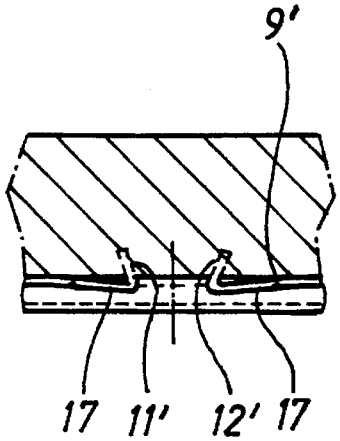
FIG. 8: The embodiment, according to FIG. 6, in an assembled state.

In the FIGS. 6 through 8, an additional embodiment of the invention is represented that the grips (11,12) can also be located in the pull-out direction laying behind one another on the support shank (5); whereby, tabs (17) are partitioned parallel to the pull-out direction of the directed slot (18) and placed behind one another in the pull-out direction. The grips (11,12) are placed around on the free ends of the tabs (17).

Also here, the knobs (9), which are placed respectively near the transition of the tabs (17) in the support shanks (5), fit in a weight transferring manner to the underside of the drawer bottom (2).

We claim:

1. A drawer side slide with fastening device for mounting a drawer bottom, comprising:

an elongate drawer side having a vertically upstanding portion and a longitudinally extending bottom edge provided with a horizontal support shank; and a tab pressed out of the support shank and partially defined by a pair of elongate open ended slots formed in the support shank, the tab having at least one pair of upwardly directed grips for inserting into the drawer bottom and having at least one upwardly directed knob for supporting the drawer bottom.

2. The drawer side slide according to claim 1, each of said grips having at least two points slanted away from each other cooperatively defining a barb engageable in said drawer bottom.

3. The drawer side slide according to claim 2, wherein each of said upwardly directed grips is obliquely disposed relative to said drawer side upstanding portion.

4. The drawer side slide according to claim 3, wherein said tab is partially defined by and disposed between said elongate open ended slots, the open ended slots extending perpendicular to said drawer side bottom edge, and the tab having a pair of upwardly directed grips for inserting into said drawer bottom and having a pair of said upwardly directed knobs for supporting the drawer bottom.

5. The drawer side slide according to claim 4, said tab having portions defining an elongate bending opening.

6. The drawer side slide according to claim 3, further comprising a pair of said tabs partially defined by said elongate open ended slots, the open ended slots extending parallel to said drawer side bottom edge, and each tab having an upwardly directed grip for inserting said drawer bottom and each tab having an upwardly directed knob for supporting the drawer bottom.

7. The drawer side slide according to claim 1, wherein each of said upwardly directed grips is obliquely disposed relative to said drawer side upstanding portion.

8. The drawer side slide according to one of claims 1 through 3, said open ended slots extending perpendicular to said drawer side bottom edge.

9. The drawer side slide according to one of claims 1 through 3, said open ended slots extending parallel to said drawer side bottom edge.

* * * * *